US009035556B2

(12) United States Patent
Hollander

(10) Patent No.: US 9,035,556 B2
(45) Date of Patent: May 19, 2015

(54) PARALLEL-CONNECTED BALLAST CIRCUITS

(76) Inventor: Jonathan Hollander, Petach Tikva (IL)

( * ) Notice: Subject to any disclaimer, the term of this patent is extended or adjusted under 35 U.S.C. 154(b) by 275 days.

(21) Appl. No.: 13/580,010

(22) PCT Filed: Mar. 4, 2010

(86) PCT No.: PCT/IB2010/050942

§ 371 (c)(1),
(2), (4) Date: Aug. 20, 2012

(87) PCT Pub. No.: WO2011/107830

PCT Pub. Date: Sep. 9, 2011

(65) Prior Publication Data

US 2012/0313530 A1 Dec. 13, 2012

(51) Int. Cl.
*H05B 37/04* (2006.01)
*H05B 41/288* (2006.01)

(52) U.S. Cl.
CPC ..... *H05B 41/288* (2013.01)

(58) Field of Classification Search
USPC ..... 315/86–87, 129, 224–226, 247, 291, 315/294, 298, 306–307
See application file for complete search history.

(56) References Cited

U.S. PATENT DOCUMENTS 6,803,679 B1 * 10/2004 Luo et al. ..... 307/66
7,638,899 B2 * 12/2009 Tracy et al. ..... 307/65
7,983,012 B2 * 7/2011 Chitta et al. ..... 361/91.6
2004/0240244 A1 12/2004 Yamanoto
2010/0301752 A1 * 12/2010 Bakre et al. ..... 315/86

FOREIGN PATENT DOCUMENTS

WO WO03005549 A1 1/2003
WO WO2006109313 A2 10/2006

OTHER PUBLICATIONS

International Search Report PCTIB2010050942.
Written Opinion of International Search Authority PCTIB2010050942.
Okui, Y et al., "Development of Parallel Processing Type UPS using a novel independent control for parallel connected UPS units" Oct. 18, 2009, Telecommunications Energy Conference 2009 IEEE, Piscataway NJ, USA pp. 1-8.

* cited by examiner

*Primary Examiner* — James H Cho
(74) *Attorney, Agent, or Firm* — Dr. Hanan Farber Patent Agent Ltd.

(57) ABSTRACT

A ballast circuit adapted for converting an input alternating current (AC) mains power received at input terminals to an output alternating current (AC) to supply a load, e.g. a gas discharge lamp. The output terminals of the ballast connect to the load in parallel with another ballast circuit. The ballast circuit is configured to supply the output AC current to the load in parallel with an AC current output of the other ballast circuit. A synchronization module attached at the output is adapted for synchronizing the output alternating current (AC) of the ballast circuit with the AC current output of the other ballast circuit. The synchronization module is configured to synchronize phase of the output alternating current with phase of the AC current output of the other ballast circuit.

17 Claims, 3 Drawing Sheets

PARALLEL-CONNECTED BALLAST CIRCUITS

BACKGROUND

1. Technical Field

The present invention relates to ballast circuits for gas-discharge lamps and in particular a system and method for load balancing between ballasts and improving reliability of lighting systems.

2. Description of Related Art

Gas-discharge lamps include fluorescent lamps, low and high pressure sodium lamps, metal halide lamps and high-intensity discharge (HID) lamps. A high-intensity discharge (HID) lamp produces light by means of an electric arc between tungsten electrodes housed inside a translucent or transparent fused quartz or fused alumina arc tube. The tube is filled with both gas and metal salts. The gas facilitates the arc's initial strike. Once the arc is started, the arc heats and evaporates the metal salts forming a plasma, which greatly increases the intensity of light produced by the arc and reduces its power consumption.

Ballasts are used where an electrical load, e.g. gas-discharge lamp cannot effectively regulate current use such as when a gas discharge lamp presents a negative (differential) resistance to the supply. If a gas-charge lamp were connected to a constant-voltage power supply, the lamp would draw an increasing amount of current until it is destroyed. To prevent this, a ballast provides a positive resistance or reactance that provides current to the gas discharge lamp at an appropriate level.

International patent application publication WO2006109313 of the same applicant discloses a system and method for configuring a single ballast for use with different power ratings and/or different lamp types. The electronic ballast includes hardware typically including a microprocessor to support a large range of output powers, e.g. 20-1000 W, and programmable parameters (or software versions) which support different types of lamps and optional features including a dimming option, and dimming delay. The manufacturer may supply hardware and/or software to a local supplier, reseller, customer or distributor for configuring the ballast. Typically, the distributor requires for configuring the ballast a computer with a connection to a communications port of the ballast. The ballast can be monitored individually or as as part of a group through its communication interface by master control software installed on a computer. Combined with a computer and optional hub, thousands of lamps can be controlled and monitored by authorized site engineers using wired or wireless connection. With the proper security authorization, a site manager can control, dim, and monitor individual and group of lamps from virtually any place on the globe.

The term "synchronization" or "synchronous" as used herein refers to maintaining identical or nearly identical phase and frequency between two or more sinusoidal alternating currents.

BRIEF SUMMARY

According to embodiments of the present invention there is provided a ballast circuit adapted for converting an input alternating current (AC) mains power received at input terminals to an output alternating current (AC) to supply a load, e.g. a gas discharge lamp. The output terminals of the ballast connect to the load in parallel with another ballast circuit. The ballast circuit is configured to supply the output AC current to the load in parallel with an AC current output of the other ballast circuit. A synchronization module attached at the output is adapted for synchronizing the output alternating current (AC) of the ballast circuit with the AC current output of the other ballast circuit. The synchronization module is typically configured to synchronize ignition outputs of the ballast circuit and said other ballast circuit. The synchronization module is configured to synchronize phase of the output alternating current with phase of the AC current output of the other ballast circuit. The synchronization module may be configured as either a master synchronization module which provides a synchronization signal to the other ballast circuit or a slave synchronization module which receives a synchronization signal from the other ballast circuit. The ballast may include a microprocessor and a communication interface attached thereto. The microprocessor may be configured to be re-programmed through the communications interface to supply to the load a higher AC current than the output AC current previously programmed.

According to an embodiment of the present invention there is provided multiple ballast circuits with respective AC outputs configured for interconnection in parallel and for supplying alternating current synchronously and in parallel to a single load. The single load is a high-intensity discharge (HID) lamp. The ballast circuits may share a synchronization signal from a single clock. Upon a failure of one (or more) of the ballast circuits, the single load continues to operate by receiving current from the remaining ballast circuits. A modular ballast system may include a chassis on which the ballast circuits are mountable. A communications junction box may be connected to the ballast circuits. The communications junction box may be adapted for communicating monitor signals from the ballast circuits and/or for communicating control signals to re-program AC output power of the ballast circuits. The communications junction box may be a single communications junction box which connects to all the ballast circuits.

According to an embodiment of the present invention there is provided a method for operating a gas discharge lamp using a modular ballast system including multiple ballast circuits with respective AC output terminals. The AC output terminals are connected in parallel to a load and output currents of the ballast circuits are synchronized. The ignition outputs of the ballast circuits are typically synchronized. The ballasts are typically previously programmed to provide a previously determined AC output power and upon receiving an alarm indicating a failure of one or more of the ballast circuits, the remaining ballast circuits are reprogrammed while still operating to provide higher output currents to compensate for the failed ballast circuit(s). Alternatively, upon failure of one of the ballast circuits the gas discharge lamp continues to operate from the output current of the other remaining ballast circuits.

BRIEF DESCRIPTION OF THE DRAWINGS

The invention is herein described, by way of example only, with reference to the accompanying drawings, wherein.

DETAILED DESCRIPTION

Figure 1:
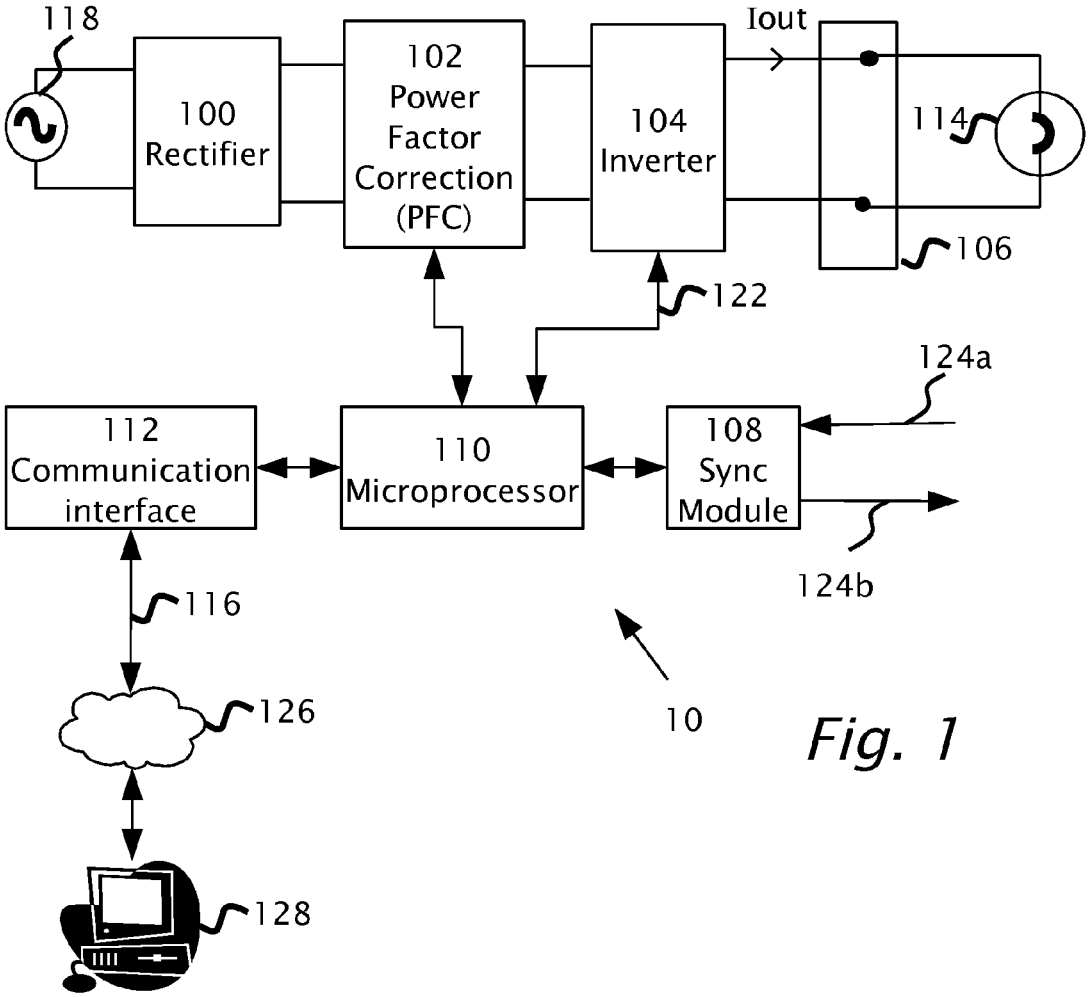
FIG. 1 shows a ballast circuit according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

By way of introduction, embodiments of the present invention are directed to allow for fail-safe operation of gas discharge lamps in a ballast lighting system so that lamps in the modular ballast lighting system continue to operate despite failure of one or more of the parallel connected ballasts providing current to a single load, e.g. one or more HID lamps.

In embodiments of the present invention, when multiple ballasts are used to supply current to a single load, e.g. a gas discharge lamp, one of the ballasts may be replaced for instance during scheduled maintenance. During replacement, the gas discharge lamp still operates, albeit at a lower power. Alternatively, the remaining operating ballasts are re-programmed on replacement of the failed ballast to supply higher currents so that the lamp continues to operate at the original power. According to other embodiments of the present invention, it may be more cost effective and/or reliable to use multiple ballast circuits at lower power than a single ballast circuit at higher power.

Reference is now made to FIG. 1 which illustrates schematically a ballast circuit 10 according to an embodiment of the present invention. Ballast circuit 10 typically includes a rectifier circuit 100, a power factor control circuit 102, an inverter circuit 104, output terminals 106, and lamp 114 all interconnected in the usual way. Monitor and control of power factor correction circuit 102 and/or inverter circuit 104 may be provided by a microprocessor 110. A communications interface 112 may connect to microprocessor 110 to enable programming and/or reprogramming of ballast operation parameters and/or to send an alarm in case one of the sensors (e.g. temperature, output current, not shown) measures a parameter to be outside an expected tolerance.

Rectifier 100 has a mains electricity input 118. Input 118 is typically a 120/240 root mean square (RMS) alternating current (AC) voltage with a frequency of 60/50 Hz. Rectifier 100 rectifies mains electricity input 118 to produce a direct current (DC) output which is input into power factor correction (PFC) circuit 102. PFC 102 is connected and controlled by microprocessor 110. The DC output of PFC 102 is connected to the input of inverter circuit 104, inverter 104 may be a "half bridge" or a "full bridge" inverter circuit. The AC output of inverter 104 is sinusoidal with a frequency typically of 100 kHz and typically provides a constant AC current output. The AC output of inverter 104 is then connected to output terminals 106. Output terminals 106 are also connected across lamp 114. Lamp 114 is typically a high intensity discharge (HID) lamp where the physical properties of lamp 114 determine the voltage across lamp 114. Lamp 114 may also be a fluorescent lamp, low or high pressure sodium lamps and metal halide lamps.

Inverter 104 is controlled by microprocessor 110 by control lines 122. Microprocessor 110 also includes a synchronization input and/or output to synchronization module 108. A synchronization module 108, according to a feature of the present invention connects to microprocessor 110. Synchronization module 108 has at least one of a synchronization output 124*b* and a synchronization input 124*a* which are connectible to synchronization modules 108 of other ballasts 10. Alternatively, microprocessor 110 may input/output a synchronization or clock signal directly as input/output 124*a*/124*b* to microprocessors 100 of other parallel connected ballasts 10. Output 124*b* and/or input 124*a* of multiple ballast circuits 10 are typically connected together to provide synchronization between the combined AC currents Iout supplying lamp 114. Communication interface 112 may be used to externally monitor and/or control ballast 10 via a network 126 to a computer 128 through data interface 116.

Figure 2:
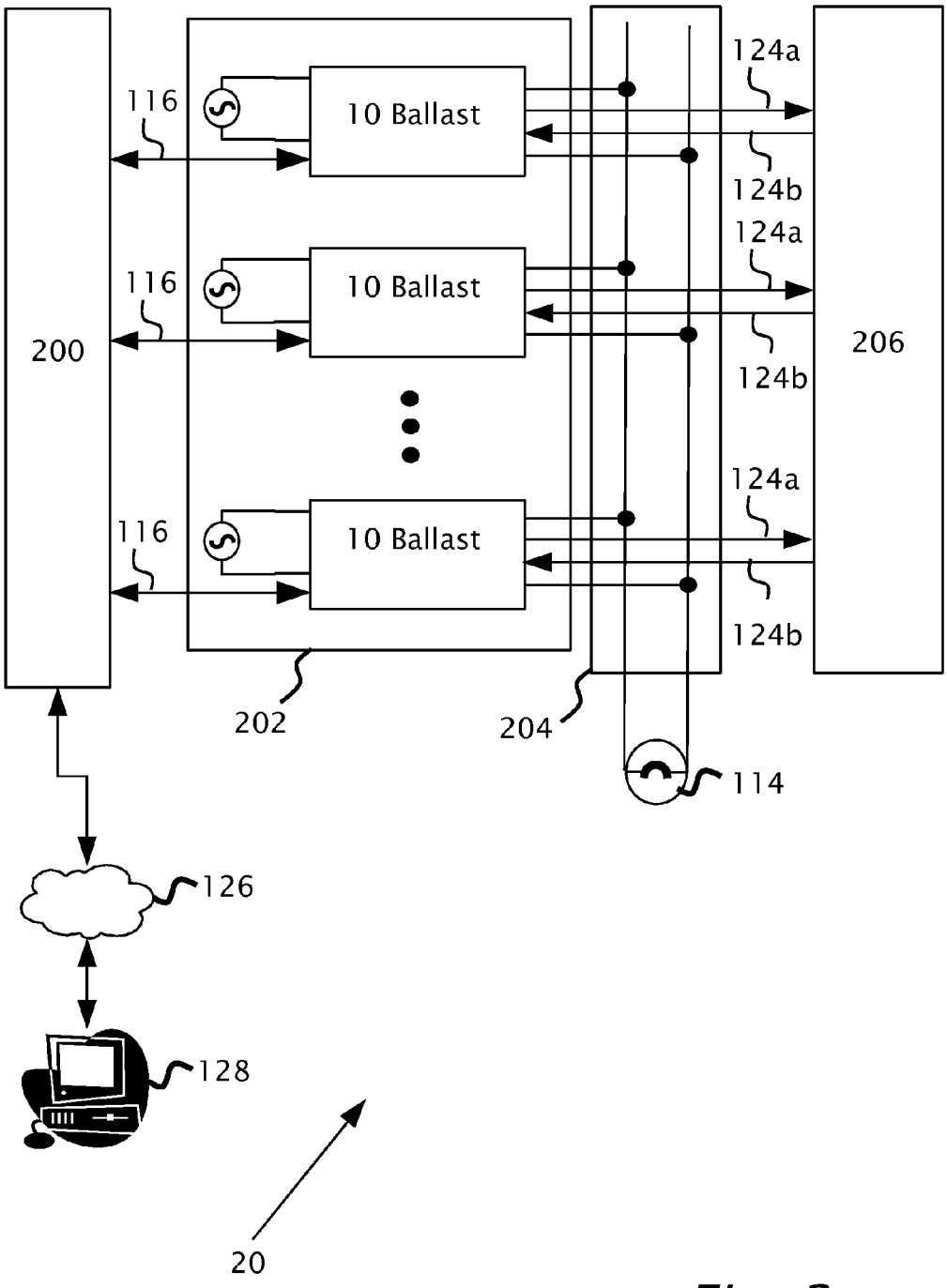
FIG. 2 shows a modular ballast system according to an embodiment of the present invention.

Reference is now made FIG. 2 which shows a modular ballast system 20 according to an embodiment of the present invention. Modular ballast system 20 includes multiple ballast circuits 10 physically and/or electrically plugged into chassis or motherboard 202. Motherboard 202 typically provides the electrical connections for multiple ballast circuits 10 to be connected to mains 118, communication junction box 200, power junction box 204 and synchronization junction box 206. Motherboard 202 typically allows multiple ballast circuits 10 to be removed or added during operation of modular ballast system 20

Power junction box 204 connects output terminals 106 of each ballast 10 in parallel and provides a connection to one HID lamp 114 or multiple lamps. Synchronization junction box 206 enables synchronization output 124*b* and/or a synchronization input 124*a* of each ballast circuit 10 to be connected together so as to allow synchronization between multiple ballast circuits 10. Connection 116 connects communication junction box 200 to communication interface 112 in each ballast circuit 10. Communication junction box 200 enables multiple connections 116 to be connected to a computer 128 and/or network 126.

Figure 3:
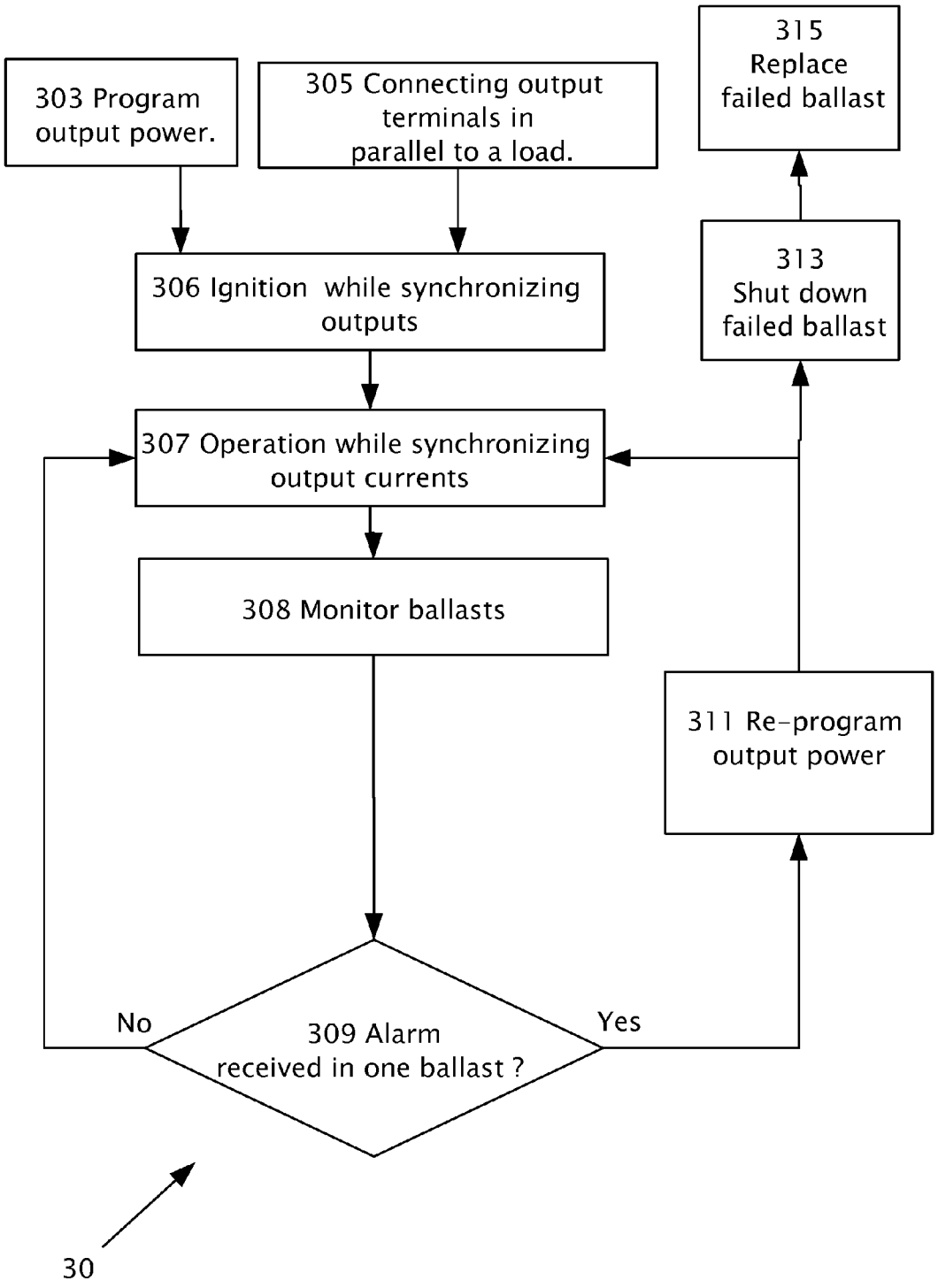
FIG. 3 which shows a method according to an embodiment of the present invention

Reference is now made FIG. 3 which shows a method 30 according to an embodiment of the present invention. Multiple ballast circuits 10 are each programmed (step 303) to provide a constant current output Iout on terminals 106. The constant output current may be first programmed (step 303) during a final test/configuration procedure in production prior to labeling and shipping. Alternatively or in addition, programming (step 303) may be performed by a distributor or installer prior to installation or operation by connecting computer 128 and/or network 126 to communication junction box 200 through communications interface 112 of ballast circuit 10.

Output terminals 106 of multiple ballast circuits 10 are connected (step 305) in parallel to lamp 114 optionally with use of power junction box 204. Typically, synchronization of outputs is performed during ignition (step 306). After ignition (step 306), normal operation (step 307) of lamp occurs while synchronizing output currents. When output terminals 106 of multiple ballast circuits 10 are connected in parallel, the total current supplied to lamp 114 is the sum of the constant current outputs Iout of each ballast circuit 10. For example, if lamp 114 is to be operated at 1200 Watts, three ballast circuits 10 with a maximum rated output of 600 watts may be programmed (step 303) to each produce current at 400 Watts to provide in unison the correct output AC current Iout to supply the 1200 Watts required. One or more synchronization signals 124 enable synchronization (step 307) of the AC output currents Iout during operation. Typically, one synchronization module 108 of one of parallel connected ballast circuits 10 may perform the role of a master synchronization module 108 which initiates and controls the transmission of synchronization signals to the other "slave" synchronization modules 108 via output 124*b* of the master to input 124*a* of the slave.

Synchronization (step 307) may according to other embodiments of the present invention be performed with use of master microprocessor 110 by outputting a clock signal to slave microprocessors 110 of other ballast circuits 10 being synchronized. Typically, each ballast circuit 10 has sensors, e.g. temperature, current, voltage which monitor (step 308) ballast operation. If an alarm is received in decision box 309 because of a failure or out of specification operation in one of ballast circuits 10, then the alarm may be communicated back through communications port 112. Computer 128 through network 126 optionally may re-program (step 311) ballast circuits 10 to increase output current Iout but typically within rated specification to compensate for the failed ballast circuit 10. Operation continues in step 307 with lamp power still at 1200 Watts being supplied by two operating ballasts 10 at 600 Watts each. Failed ballast 10 may be shut down completely (step 313). Replacement (step 315) of failed ballast may be scheduled at a later date because lamp 114 is presently operating at full rated power of 1200 Watts. Alternatively, after failure of one ballast, continued operation may be at less than the fully rated power, for instance at 800 Watts without re-programming (step 311).

The definite articles "a", "an" is used herein, such as "a ballast", "a lamp" have the meaning of "one or more" that is "one or more ballasts" or "one or more lamps".

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

The invention claimed is:

1. A ballast circuit adapted for converting an input alternating current AC mains power received at input terminals to an output alternating current (AC) to supply a load, the ballast circuit comprising:

an output terminal adapted for connection to the load in parallel with another ballast circuit, wherein the ballast circuit is configured to supply the output AC current to the load in parallel with an AC current output of the other ballast circuit;

a synchronization module operatively attached to said output terminal, the synchronization module adapted for synchronizing the output alternating current (AC) of the ballast circuit with said AC current output of said other ballast circuit; and a microprocessor and a communication interface attached thereto, wherein the microprocessor is configured to be re-programmed through said communications interface to supply a higher AC current than the output AC current previously programmed.

2. The ballast circuit of claim 1, wherein said synchronization module is configured to synchronize phase of the output alternating current with phase of said AC current output of said other ballast circuit.

3. The ballast circuit of claim 1, wherein said synchronization module is configured to synchronize ignition outputs of the ballast circuit and said other ballast circuit.

4. The ballast circuit of claim 1, wherein said synchronization module is configured as selectably either a master synchronization module which provides a synchronization signal to said other ballast circuit or a slave synchronization module which receives a synchronization signal from said other ballast circuit.

5. A modular ballast system comprising:

a plurality of ballast circuits with respective AC outputs configured for interconnection in parallel and for supplying alternating current synchronously and in parallel to a load, wherein said ballast circuits include:

an output terminal adapted for connection to the load in parallel with another ballast circuit, wherein the ballast circuit is configured to supply the output AC current to the load in parallel with an AC current output of the other ballast circuit;

a synchronization module operatively attached to said output terminal, the synchronization module adapted for synchronizing the output alternating current (AC) of the ballast circuit with said AC current output of said other ballast circuit; and a microprocessor and a communication interface attached thereto, wherein the microprocessor is configured to be re-programmed through said communications interface to supply a higher AC current than the output AC current previously programmed.

6. The modular ballast system of claim 5, further comprising:

a clock, wherein the ballast circuits share a synchronization signal from said clock.

7. The modular ballast system of claim 5, wherein said oad is a high intensity discharge (HID) lamp.

8. The modular ballast system of claim 5, wherein upon a failure of at least one of said ballast circuits, said load continues to operate by receiving current from the remaining ballast circuits.

9. The modular ballast system of claim 5, further comprising a chassis on which said ballast circuits are mountable.

10. The modular ballast system of claim 5 further comprising:

a communications junction box operatively connected to said ballast circuits, wherein said communications junction box is adapted for communicating monitor signals from said ballast circuits.

11. The modular ballast system of claim 10, wherein said communications junction box is a single communications junction box which connects to all said ballast circuits.

12. The modular ballast system of claim 5 further comprising:

a communications junction box operatively connected to said ballast circuits, wherein said communications junction box is adapted to communicate control signals to re-program the previously programmed AC output power of said ballast circuits.

13. The modular ballast system of claim 12, wherein said communications junction box is a single communications junction box which connects to all said ballast circuits.

14. A method for operating a modular ballast system including a plurality of ballast circuits with respective AC output terminals, wherein the ballast circuits include a microprocessor and a communication interface attached thereto, the method comprising:

connecting said AC output terminals in parallel to a load;

re-programming through the communications interfaces to supply a higher AC current than the output AC current previously programmed; and synchronizing output currents of said ballast circuits.

15. The method of claim 14, further comprising:

synchronizing ignition outputs of said ballast circuits.

16. The method of claim 14, further comprising:

previously programming to provide a previously determined AC output power; and upon receiving an alarm indicating a failure of at least one of said ballast circuits, performing said reprogramming of the remaining ballast circuits still operating to provide higher output currents to compensate for the failed at least one ballast circuit.

17. The method of claim 14, further comprising:

upon failure of at least one of said ballast circuits, continuing to provide output current from the other remaining ballast circuits.

* * * * *